United States Patent [19]

Mather

[11] 4,187,976

[45] Feb. 12, 1980

[54] COLLAPSIBLE CONTAINER WITH REINFORCING MEMBERS

[75] Inventor: George A. Mather, Foxboro, Mass.

[73] Assignee: Champion International Corporation, Stamford, Conn.

[21] Appl. No.: 937,208

[22] Filed: Aug. 28, 1978

[51] Int. Cl.[2] ..... B65D 5/36; B65D 5/44

[52] U.S. Cl. ..... 229/41 B

[58] Field of Search ..... 229/34 HW, 41 B, 41 R

[56] References Cited

U.S. PATENT DOCUMENTS

| | | | |
|---|---|---|---|
| 2,163,117 | 6/1939 | Evans et al. | 229/34 HW |
| 2,898,029 | 8/1959 | Sherman | 229/41 B |
| 2,943,780 | 7/1960 | Bolding | 229/41 B X |
| 3,014,635 | 12/1961 | Mairs et al. | 229/34 HW X |

FOREIGN PATENT DOCUMENTS

| | | | |
|---|---|---|---|
| 115106 | 7/1968 | Norway | 229/34 HW |

*Primary Examiner*—Davis T. Moorhead
*Attorney, Agent, or Firm*—Evelyn M. Sommer

[57] ABSTRACT

A rectangular, collapsible container includes a collapsible lock bottom structure in which each bottom side flap is glued to a bottom end flap. At least two of the bottom flaps have fold lines which permit the box bottom to collapse inwardly. The container includes cover flaps which extend from the upper edges of side wall panels and which overlap one another in a closed position. Reinforcing members extend from the upper edges of the end wall panels. Each reinforcing member includes a relatively narrow bridge panel which extends toward the opposite end panel and a locking panel of which extends downwardly from the edge of the bridge panel to a position at the bottom of the container at which it engages a bottom or floor panel to help rigidify the container. Preferably, the container is made from a one piece blank of a suitable sheet material such as cardboard or containerboard.

10 Claims, 6 Drawing Figures

Fig. 1.
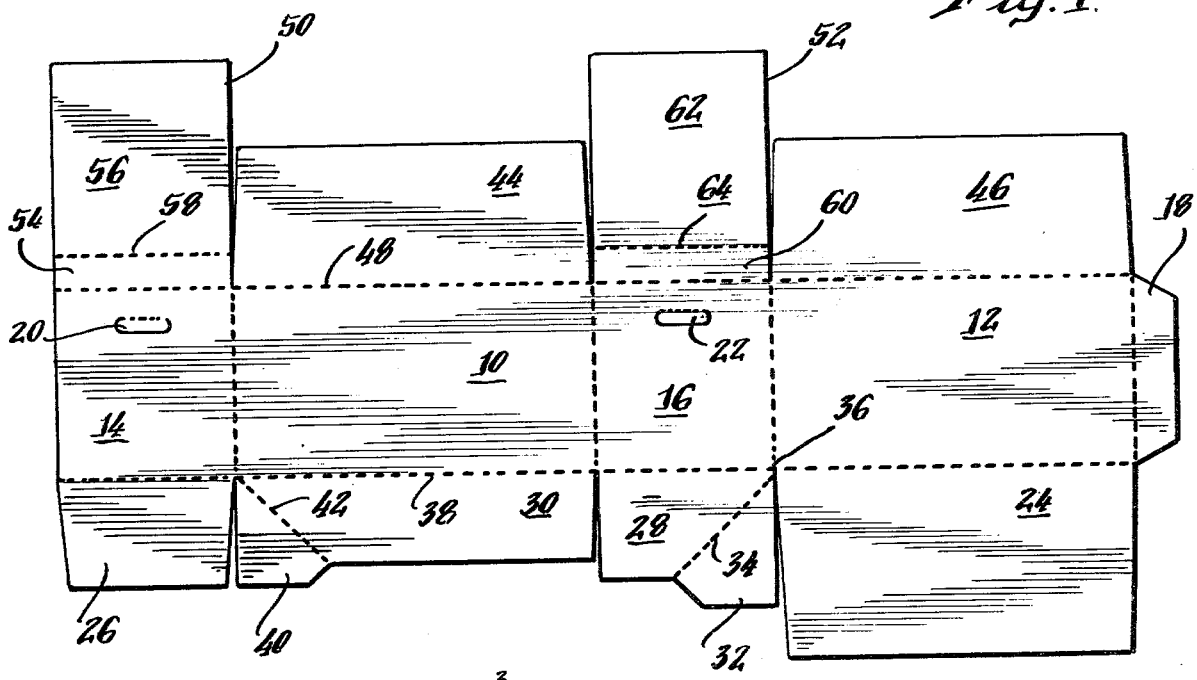
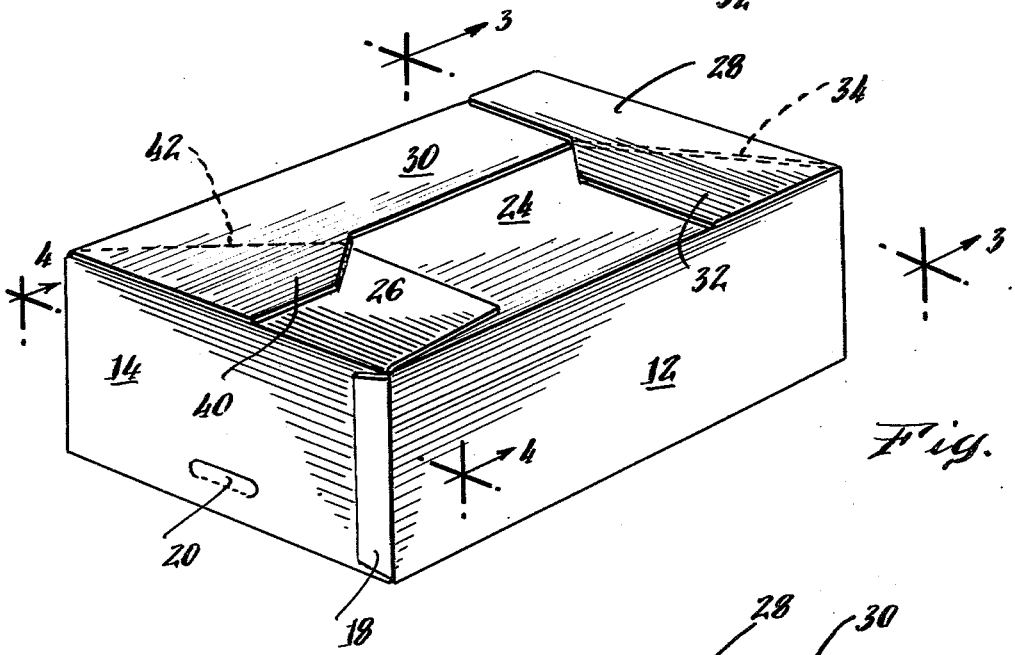
Fig. 2.
Fig. 3.
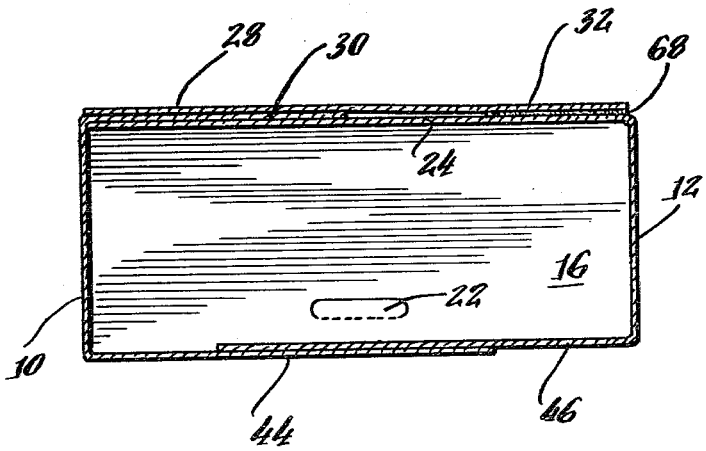

COLLAPSIBLE CONTAINER WITH REINFORCING MEMBERS

BACKGROUND OF THE INVENTION

The present invention relates to containers and more particularly to a collapsible container having reinforcing members.

One well known type of container is a collapsible container which can be shipped and stored in substantially flat form until it is needed. The container then can be set up or erected without the need to glue any of the container panels together.

One disadvantage of many of the heretofore available containers is that the structure which allows them to be collapsed for shipment and storage tends not to be as strong or as rigid as a container structure which is erected on site by gluing. Thus, collapsible containers have generally not been regarded as being suitable where heavy loads are to be carried.

SUMMARY OF THE INVENTION

The present invention is a collapsible container which is strong enough to carry heavy loads. The container includes generally rectangular side walls and end walls connected together to form a rectangular tube. A bottom wall assembly includes a generally rectangular bottom panel extending from the lower edge of one of the side walls and a plurality of bottom flaps extending from the lower edges of the remaining walls. The bottom panel and the bottom flaps are secured to one another to form a collapsible wall structure. To help rigidify and strengthen the container, first and second reinforcing members are provided. Each reinforcing member extends from the upper edge of one of the end walls and includes a bridge panel which extends toward the other end wall. A locking panel extends from each bridge panel toward the bottom wall of the container. This locking panel engages the bottom panel to help rigidify the container.

DESCRIPTION OF THE DRAWINGS

While the specification concludes with claims particularly pointing out and distinctly claiming that which is regarded as the present invention, details of a preferred embodiment of the invention may be more readily ascertained from the following detailed description when read in conjunction with the accompanying drawing wherein:

FIG. 1 is a plan view of a one-piece blank from which a container incorporating the present invention may be erected;

FIG. 2 is perspective view showing the bottom wall of a container erected from the blank of FIG. 1;

FIG. 3 is a cross-sectional view taken along lines 3—3 of FIG. 2;

DETAILED DESCRIPTION

Figure 4:
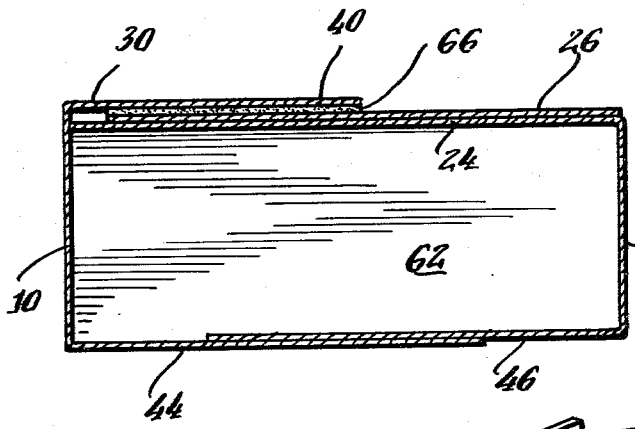
FIG. 4 is another cross-sectional view taken along lines 4—4 of FIG. 2.

Referring to FIG. 1, a one piece blank constructed in accordance with the present invention includes a side wall structure consisting of first and second side wall panels 10 and 12 and alternating end wall panels 14 and 16. The side wall panels and end wall panels are connected along vertical fold lines. A relatively narrow, trapezoidal glue flap 18 extends from one vertical edge of side wall panel 12 and is coated with a conventional adhesive layer which allows the glue flap 18 to be bonded to the exterior surface of end wall panel 14 to form a rectangular tube structure. The end wall panels 14 and 16 preferably include hand holes 20 and 22, respectively, consisting of upwardly-facing c-shaped cuts. The hand holes 20 and 22 are conventional in nature.

A collapsible bottom wall assembly for the container can be fabricated from a generally rectangular bottom panel 24 extending from the lower edge of side wall panel 12, a first bottom end flap 26 extending from the lower edge of end wall panel 14, a second bottom end flap 28 extending from the lower edge of end wall panel 16 and a bottom side flap 30 extending from the lower edge of side wall panel 10. Bottom panel 24 is substantially as long as the side wall panel from which it extends and as wide as the end wall panels 14 and 16 and provides a floor panel for the entire area bounded by the lower edges of the container wall panels. The first bottom end flap 26 has slightly tapered side edges. The second bottom flap 28 is irregularly shaped and includes a glue panel 32 set off from the remainder of the flap 28 by a fold line 34 which extends from a bottom corner 36, common to side wall panel 12 and end wall panel 16, to the outer edge of flap 28. The fold line 34 radiates from corner 36 at an angle of 45° relative to a continuous lower edge 38 for the wall panels.

Bottom side flap 30 also includes a glue panel 40 set off from the remainder of the flap by a fold line 42 extending from a common corner of side wall 10 and end wall 14. The fold line 42 similarly extends at an angle of 45° from the continuous lower edge 38.

The top structure for the container includes first and second generally rectangular cover flaps 44 and 46 extending upwardly from a fold line 48 defining the upper edges of the wall panels. The cover flaps 44 and 46, which are as wide as the side wall panels 10 and 12, respectively, from which they extend, have a length or vertical dimension somewhat greater than the width of the end wall panels 14 and 16. In the erected carton, the cover flaps 44 and 46 overlap in a container-closing position.

The container further includes reinforcing members 50 and 52 extending from the fold line 48 at the upper edges of end wall panels 14 and 16, respectively. The reinforcing members 50 and 52 are identical, each consisting of a relatively narrow bridge panel adjacent the continuous upper edge 48 and a larger locking panel extending from the outer edge of the associated bridge panel. A fold line separating the locking panel from the associated bridge panel is parallel to the upper edge 48. For example, reinforcing member 50 has a relatively narrow bridge panel 54 and a much larger locking panel 56 divided by a fold line 58. Reinforcing member 52 similarly includes a bridge panel 60, a locking panel 62 and a fold line 64. The locking panels 56 and 62 have a vertical dimension slightly greater than the vertical dimension of the side walls and end walls; that is, slightly greater than the distance between the continuous upper edge 48 and the continuous lower edge 38.

Referring to FIGS. 2, 3 and 4, all of which show an erected, closed carton in an inverted position, in order to better illustrate the bottom wall assembly, a container is erected from the above-described blank by folding the side walls 10 and 12 and end walls 14 and 16 into a rectangular open-ended tube and by securing the glue flap 18 to the exterior surface of end wall 14 by means of a conventional adhesive applied either to the flap 18 or the end wall 14. Rectangular bottom panel 24 is folded inwardly until it is parallel to the continuous lower edge 38. Bottom flap 26 is folded inwardly against panel 24 but the two are not bonded in any way. Then, bottom side flap 30 is folded inwardly and is bonded only to bottom end flap 26 by means of adhesive 66 (FIG. 4 only) applied to the underside of glue panel 40. Finally, bottom end flap 28 is folded inwardly and is glued to bottom panel 24 by means of adhesive layer 68 (FIG. 3 only) applied to the underside of glue panel 32.

The bottom wall assembly, formed in the manner described above, can be collapsed inwardly after it is erected to allow the carton to be shipped and stored in a substantially flat state. During shipment and storage, the cover flaps 44 and 46 and the reinforcing members 50 and 52 remain unfolded; that is, remain planar with the side walls or end walls to which they are connected. When the container is to be used, it is first set up in the form of an open-topped rectangular box by folding the bottom panels or flaps downward to form a bottom closure. Since the bottom panel 24 is substantially as long as the side wall panel from which it extends and as wide as the end wall panels, panel 24 provides a complete, unbroken floor for the container which helps to prevent contamination of the container contents.

Figure 5:
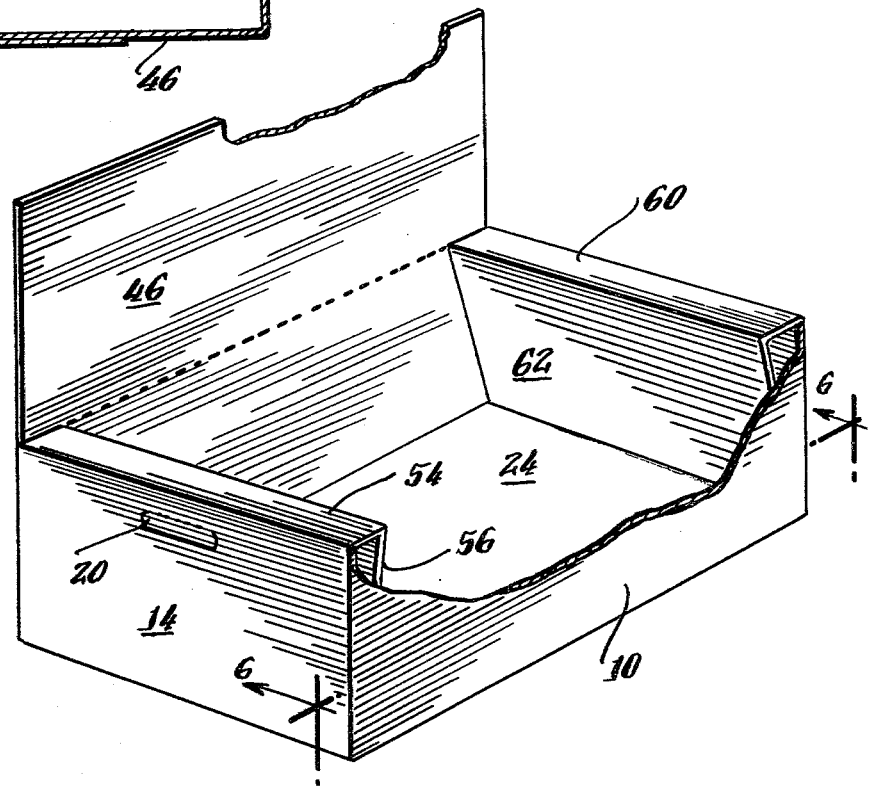
FIG. 5 is perspective view of an erected container in its upright position with a portion of one side wall being removed for purposes of illustration.
Figure 6:
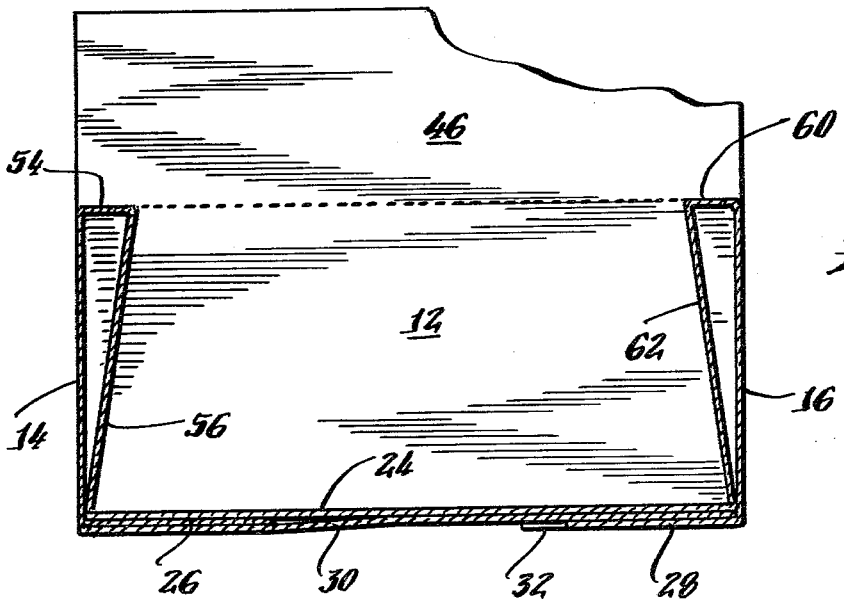
FIG. 6 is a cross-sectional view taken along lines 6—6 of FIG. 5.

Referring to FIGS. 5 and 6 together, when the container has been erected to form an open-topped box, the reinforcing members 50 and 52 are folded inwardly or toward one another until the bridge panels 54 and 60 are substantially parallel to the continuous upper edge 48 of the container. The locking panels 56 and 62 are folded downwardly or toward the container bottom wall until they engage the edge of the bottom panel 24. Since the locking panels 56 and 52 are slightly longer than the vertical dimension of the end walls 14 and 16, an air cell is created at the end of the carton by each end wall and its associated bridge panel and locking panel. The triangular configuration of this reinforcing structure and the engagement of the lower end of each locking panel with one edge of the bottom panel 24 helps to rigidify the carton by peventing unintentional inward collapsing of the bottom wall assembly.

Moreover, the reinforcing members provide an inner end wall structure which serves as a barrier between the container contents and the openings formed by hand holes 20 and 22.

Finally, the reinforcing members improve the stackability of the carton since the bridge panels provide a support area for the cover flaps 44 and 46 when those flaps are closed. Since the bridge panels are in turn supported by the locking panels, the rigidity of the container in a vertical direction is greatly enhanced.

While there has been described what is considered to be a preferred embodiment of the present invention, variations and modifications therein will occur to those skilled in the art once they become acquainted with the basic concepts of the invention. Therefore, it is intended that the appended claims shall be construed to include not only the preferred embodiment but all variations and modifications as fall within the true spirit and scope of the invention.

What is claimed is:

1. A collapsible container comprising:

first and second generally rectangular side walls;

first and second generally rectangular end walls connecting said side walls to form a rectangular tube; and a bottom wall assembly including -

(1) a generally rectangular bottom panel joined along a lower edge of one of said side walls, (2) a first bottom flap joined along a lower edge of one of said end walls and including a single foldable segment integral therewith on one extremity thereof defined by a fold line in said first bottom flap extending diagonally outward from said one end wall, (3) a second bottom flap joined along a lower edge of the side wall opposite said one side wall, portions of one extremity of said second bottom flap being sandwiched between said bottom panel and said first bottom flap, the opposite extremity of said second bottom flap including a single foldable segment integral therewith and defined by a fold line in said second bottom flap, said last mentioned fold line extending diagonally outward from said opposite side wall, (4) a third bottom flap joined along a lower edge of the end wall opposite said one end wall and including portions thereof sandwiched between said bottom panel and said second bottom flap, said first and second bottom flaps being respectively foldable into overlapping relationship with said one side wall and said opposite side wall when said container is in a collapsed condition.

2. A container as defined in claim 1, including first and second reinforcing members extending from the upper edges of said end walls, each of said reinforcing members including a bridge panel extending from one end wall toward the other end wall and a locking panel extending from said bridge panel toward the bottom wall assembly, said locking panel engaging said bottom panel to further ridigify the container.

3. A container as defined in claim 2, wherein said bridge panel extends substantially parallel to the upper edges of said side walls and said end walls while said locking panel extends toward the adjacent end wall, said adjacent end wall, bridge panel and locking panel forming an air cell having a generally triangular cross-section.

4. A container as defined in claim 3, wherein said bridge panel and said locking panel are substantially rectangular members of the same width as the end wall from which they extend, said bridge panel and said locking panel being connected at a fold line parallel to the upper edge of said end wall.

5. A container as defined in claim 1, wherein each of said segments comprises a glue panel, the glue panel associated with said first bottom flap being secured to said bottom flap, the glue panel associated with said second bottom flap being secured to said third bottom flap.

6. A blank for forming the container of claim 1.

7. A blank for forming the container of claim 2.

8. A blank for forming the container of claim 3.

9. A blank for forming the container of claim 4.

10. A blank for forming the container of claim 5.

* * * * *